United States Patent [19]

Warren

[11] 3,948,521

[45] Apr. 6, 1976

[54] BALL GAME AND APPARATUS

[76] Inventor: John E. C. Warren, 509 Riverside Drive, Melbourne Beach, Fla. 32951

[22] Filed: Mar. 21, 1972

[21] Appl. No.: 236,660

[52] U.S. Cl. ..... 273/95 R; 273/95 H

[51] Int. Cl.[2] ..... A63B 71/00

[58] Field of Search .... 273/67 B, 25 R, 26 R, 95 R, 273/95 H, 1 R, 118 R, 127 R, 67 R

[56] References Cited

UNITED STATES PATENTS

| | | | |
|---|---|---|---|
| 1,368,021 | 2/1921 | Cassell | 273/95 R |
| 1,589,312 | 6/1926 | Hill | 273/1 R |
| 2,366,782 | 1/1945 | Gorsuch | 273/118 R |
| 2,527,906 | 10/1950 | Bennett | 273/26 R |
| 2,542,100 | 2/1951 | Sturm | 273/97 R X |
| 3,024,024 | 3/1962 | Chalcroft | 273/1 R |
| 3,231,278 | 1/1966 | Boulanger | 273/95 H |

*Primary Examiner*—Paul E. Shapiro
*Assistant Examiner*—Marvin Siskind
*Attorney, Agent, or Firm*—Warren E. Ray

[57] ABSTRACT

A ball game involving from three to 24 players including a marked playing surface, a single batter's post with soft-ball size target ball on top, a bat (may have a resilient sleeve) for the batter stationed near the batter's post, and a larger ball, hollow, rubber, about 8 inches in diameter, for use by players in attempting to topple the target ball off of the batter's post to retire the batter.

15 Claims, 10 Drawing Figures

Fig. 1
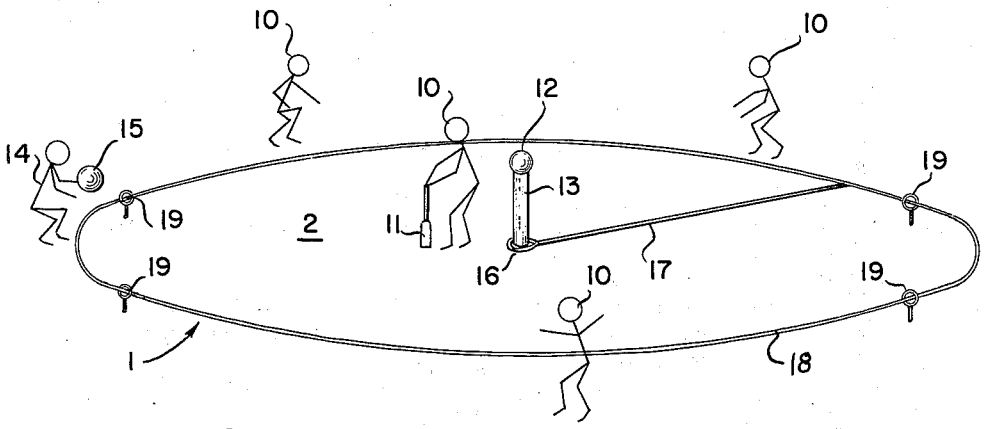
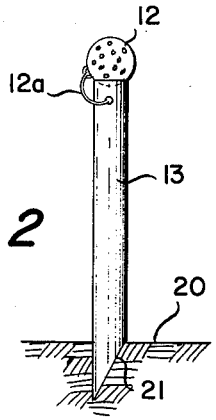
Fig. 2
Fig. 3
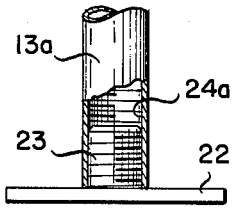
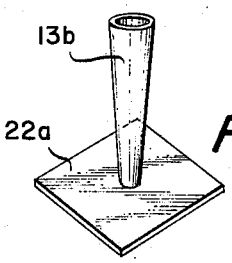
Fig. 4
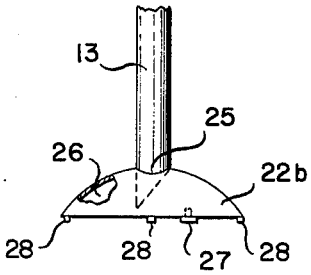
Fig. 5
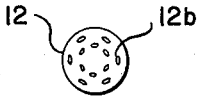
Fig. 6
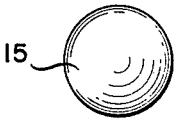
Fig. 7
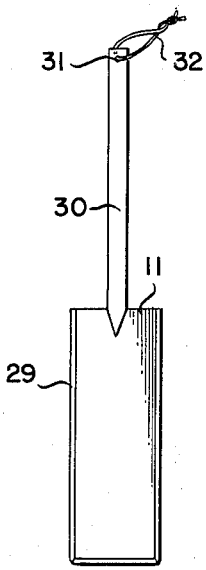
Fig. 8
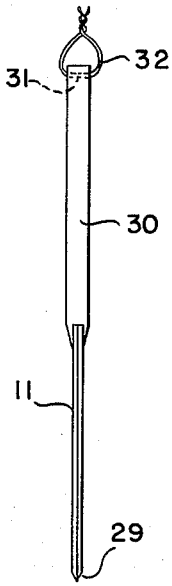
Fig. 9
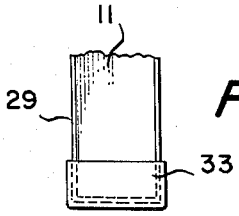
Fig. 10

BALL GAME AND APPARATUS

CROSS-REFERENCE TO RELATED APPLICATIONS

There are no related applications.

This invention relates to a novel ball game involving a pair of balls whereby recreation and exercise may be provided to a variable number of players, say from three to 24, from an age when the player is strong enough to lift the bat or throw the ball to older players including adults.

Within applicant's knowledge there are no known references. The U.S. Pat. No. to CHALCROFT, 3,024,024 (273-1), may be of some remote interest.

BRIEF SUMMARY OF THE INVENTION

The nature and substance of the invention is believed to be set forth in the foregoing with particular reference to the Abstract.

The primary object is to provide a ball game and apparatus therefor involving a variable number of players, requiring a limited playing area as compared to, say, a soft ball diamond, which may be indoors or outdoors, and in which the equipment may be said to be inexpensive for the number of players.

Another object is to provide simple and inexpensive equipment which is quickly and easily set up for playing the game and which is easily removed for placing in a container, e.g., a canvas bag, for storage or carrying.

The invention in the foregoing aspects and in other advantageous, related, or subsiduary aspects will be fully apprehended from the following detailed description of preferred embodiments taken in conjunction with the appended drawing, in which:

BRIEF DESCRIPTION OF THE SEVERAL VIEWS OF THE DRAWING

FIG. 1 is a schematic view from an upper angle of the game layout showing player positions and equipment;

FIG. 2 is a side view of the batter's post with target ball;

FIG. 3 shows a side view of a modified batter's post;

FIG. 4 is a pictorial view of a second modified batter's post;

FIG. 5 depicts a third modified batter's post;

FIG. 6 shows a preferred target ball;

FIG. 7 is a view of the ball used by the players other than the batter;

FIG. 8 is a front view of the batter's paddle or bat;

FIG. 9 is a side view of the paddle of FIG. 8; and

FIG. 10 illustrates a resilient sleeve on the end of the paddle.

Similar reference numerals are applied to similar elements throughout the drawing.

DETAILED DESCRIPTION

Referring now to the drawing, and more particularly to FIG. 1, the numeral 1 generally indicates the topleball game (the name being one coined by the applicant) and 2 indicates the inner playing surface. A player 10 holding a paddle 11 stands beside the batter's post 13 on top of which is placed a target ball 12. Ring 16 and radius cord 17 of nylon or plastic cord, the radius being preferably between 13 and 15 feet, is used to lay out the game circle cord 18 made of 1/8 inch diameter plastic cord, preferably, or any other suitable material and dimensions, the latter cord being between 82 and 95 feet in length according to the radius selected. The game cord 18 may be held closely to the lawn by means of any number of pins with eyes 19. After the game cord is positioned the measuring cord 17 is placed aside. It should be noted here that the batter 10 with paddle 11 is stationed near the batter's post initially to protect the target ball 12 which will be dislodged by efforts of players 10, stationed outside of the game circle, by means of the ball 15. The player with the ball is designated by numeral 14.

Referring now to FIG. 2, the batter's post 13 is a hollow rigid plastic member, about 2 inches in diameter, although almost any other diameter could be chosen, having an angled cut portion 21 for ease in pushing the same into soft or sandy soil 20. The target ball 12 may be tethered to the post 13 with a thong **12*a* although it will be recognized that the thong 12*a* is not indispensible to playing the game. When the outdoor court is not susceptible to having the batter's post pushed into the soil other types of posts are provided for hard outdoor courts and indoor courts when such indoor courts are desirable because of inclement weather. FIG. 3 shows a modified batter's post 13*a* similar to 13 having internal threads 24*a* for mating with external threads on protuberance 23 on base 22. A second modified batter's post 13*b* is depicted in FIG. 4 having a square or rectangular (or other configuration) base 22*a*. Still another modified post assembly is shown in FIG. 5 with post 13, hemispherical base 22*b* having a hole 25 for the post, a cavity 26 for receiving a filler material such as sand with a filler hole and stopper 27 and including spaced legs 28 or a rim. The modified posts of FIGS. 3–5 may be used indoors or outdoors with the post of FIG. 2** being preferred for outdoors when the soil permits.

FIG. 6 illustrates the target ball 12, a hollow spherical plastic member with performations **12*b*** for less weight and resiliency. The diameter of the target ball may be 3 to 6 inches or any desired diameter. Actually the target ball may be an object such as a beer can, but the spherical shape is desirable for safety reasons.

FIG. 7 depicts the outline of the player's ball 15 which preferably is a hollow rubber ball about 8 inches in diameter having a skin thickness such that the weight is about 12 ounces. Here again, it should be noted, the type, weight, and size of the ball is not especially critical. It will be readily appreciated that, as with the target ball, other balls might be substituted.

In FIGS. 8 and 9 is shown the paddle or bat 11 used by the batter 10. The handle 30, preferably about 1¾ inches in diameter with a hole 31 and wrist thong 32 for safety reasons, extends from a blade 11 desirably about 8 inches wide and 20 inches long having bevels 29 for safety. The entire paddle may be of wood weighing about 4 pounds. Obviously the paddle 11 could be made of other materials, if desired, having other dimensions and weight. The numeral 33 in FIG. 10 indicates a resilient rubber or plastic sleeve that may be slipped over the end of the paddle when the game is played indoors for protection of wooden or other floors.

It will be readily recognized by those skilled and unskilled in the art that the materials and dimensions above described are not critical and that these may be changed as desired or as expediency may dictate.

The equipment having been described above the playing of the game, as presently contemplated, will be described. It may be noted that prototypes of the apparatus have been built and the game tested with various organizations including school groups. After an initial period with the apparatus of the novel game it can be said that the game has been enthusiastically received and played. After a short period of familiarization, most groups do not want to stop playing the game.

First, the playing field is laid out with the aid of post 13, measuring cord 17 and ring 16, game circle cord 18, and pins 19. When the ground is hard or the game is played indoors, the alternate batter's post of FIGS. 3–5 may be used. In the case of indoor courts the game circle may be marked with chalk or the game circle cord 18 may be fastened to the floor with ordinary pressure-sensitive tape. While rubber suction cups could be used to hold cord 18 to the floor, due to the hazard of "turned ankles" it is preferable that the game circle cord be fastened to the floor with tape or marked thereon with chalk or other suitable marking materials.

As mentioned heretofore the number of players may number between three and 24 including a batter. Preferably the field outside of the game circle should be a 50 foot square. An initial batter is chosen and the remaining players position themselves outside the playing circle. Subsequent batters are selected by proceeding clockwise around the circle or as otherwise may be decided. The batter's opponents are all of the other players. A complete game of toppleball consists of one batting turn for each participant.

The objective of the batter is to secure the most runs before the target ball is knocked down, and conversely the objective of the remaining players is to minimize the runs obtained by the batter by getting him out, i.e., topple the ball off of the batter's post.

The game is in play when the batter is in front of the batter's post with his paddle touching the ground with the remaining players outside of the game circle. All of the players except the batter must remain outside of the game circle or their shots at the target ball do not count. The players outside of the game circle may pass the player ball to one another. When a clear shot at the target ball presents iself, a player may fire the ball at the target ball or batter's post with the object of dislodging the target ball, but the ball on such a shot must not be higher than the waist of the batter. A run is scored by the batter when he hits the player ball over or through the opposing players giving him an opportunity to leave the target unprotected. A run counts when the batter runs to the outer circle, touches his bat outside the game circle, and returns to the post. A batter may obtain as many runs as he is able to get when the ball is in the field. The out-of-bounds outside the game circle may be established before the game begins. A hit by the batter into out-of-bounds territory might count three runs without the necessity of his running to and fro.

To put the batter out, the players in the field must knock the target from the post. As said heretofore, the players may pass the ball between themselves while waiting for a clear shot. If the batter inadvertently dislodges the target with his body while running around the post, he will not be considered out. If, however, the batter dislodges the target with his bat as a result of defending the target, he will be considered out.

The batter, when hitting the ball with the paddle, will only use the flat side of the paddle, or any runs obtained will be disallowed. It is the duty of the batter to call out the total number of runs he has achieved after each run or runs is or are completed. If he fails to do so, he is allowed to count as his score only the number of runs he actually last called. It is considered unsportsmanlike for the batter to simply stand in front of the batter's post since he is thereby playing a defensive game only and not persuing the batter's objective of maximizing runs during his term at bat (and also slowing the game down).

It is also considered unsportsmanlike for a player to fire the ball at the batter above his waist and likewise for a player to delay his retrieval of the ball while the batter is running.

The above description of the playing of the game is exemplary and is not to be considered as limiting since simple rule changes may be made within the spirit of the game disclosed.

While for purposes of description I have shown and described specific embodiments of my invention, and the way to play the game, it will be apparent that changes and modifications can be made therein without departing from the spirit of my invention or the scope of the appended claims.

I claim:

1. Game and apparatus therefor wherein the apparatus comprises a single batter's post, a paddle means for the batter, a playing surface means, said playing surface means including a game area means, a target means normally atop said batter's post, and a player's means normally utilized by a player to dislodge the said target means from said batter's post to get the batter out.

2. Game and apparatus according to claim 1 wherein said batter's post comprises a hollow cylindrical tube having an angled portion on the lower end for easy insertion into soft or sandy ground.

3. Game and apparatus according to claim 2 wherein said batter's post further comprises a base into which said tube in insertable.

4. Game and apparatus according to claim 1 wherein said batter's post and said target means include a tether therebetween.

5. Game and apparatus according to claim 1 wherein said batter's post includes a tube, and a base portion connected to said tube.

6. Game and apparatus according to claim 1 wherein said target means comprises a spherical means.

7. Game and apparatus according to claim 6 wherein said spherical means comprises a hollow perforated spherical ball.

8. Game and apparatus according to claim 1 wherein said player's means comprises a spherical hollow rubber ball.

9. Game and apparatus according to claim 1 wherein said paddle means includes a blade portion and a handle portion.

10. Game and apparatus according to claim 9 wherein said handle portion includes a wrist thong member.

11. Game and apparatus according to claim 9 wherein said paddle means blade portion includes a removable resilient sleeve.

12. Game and apparatus according to claim 1 wherein said game area includes a game circle marking member.

13. Game and apparatus according to claim 12 wherein said game circle marking member is fastened to said playing surface means by pins.

14. Game and apparatus according to claim 1 wherein said game area means includes measuring means to establish the game area means.

15. Game and apparatus according to claim 1 wherein said game area means comprises a circular area on said playing surface means.

* * * * *